United States Patent [19]

Lieptz

[11] Patent Number: 4,680,824

[45] Date of Patent: Jul. 21, 1987

[54] FLEXIBLE GUN-BORE CLEANING IMPLEMENT WITH ROTATABLE PUSHER END

[76] Inventor: Nathan S. Lieptz, 23506 Beachwood Blvd., Beachwood, Ohio 44122

[21] Appl. No.: 836,728

[22] Filed: Mar. 6, 1986

[51] Int. Cl.[4] ..... F41C 31/00

[52] U.S. Cl. ..... 15/104.165; 15/104.16; 42/95

[58] Field of Search ..... 15/104.16, 104.165, 15/104.2, 143 R, 104.05, 211; 42/95, 96

[56] References Cited

U.S. PATENT DOCUMENTS

| | | | |
|---|---|---|---|
| 810,913 | 1/1906 | Coleman | 15/104.2 |
| 877,778 | 1/1908 | Kauffman | 15/104.16 |
| 2,420,044 | 5/1947 | Jowett | 15/104.165 |
| 2,544,150 | 3/1951 | Franklin | 15/104.16 |

FOREIGN PATENT DOCUMENTS

| | | | |
|---|---|---|---|
| 1899 | of 1905 | United Kingdom | 15/104.165 |

*Primary Examiner*—Edward L. Roberts
*Attorney, Agent, or Firm*—Isler and Ornstein

[57] ABSTRACT

A cleaning rod or implement for the bore of airguns, which rod has a highly flexible, non-metallic tubular body having a rotatably-mounted pusher piece secured at one end thereof for pushing a cleaning pellet through the bore of the gun and expelling it from the muzzle, while tracking and following the rifling, said pusher piece having an angularly divergent surface engaging the pellet to compress the trailing end thereof.

5 Claims, 4 Drawing Figures

FLEXIBLE GUN-BORE CLEANING IMPLEMENT WITH ROTATABLE PUSHER END

BACKGROUND OF THE INVENTION

The invention relates to a cleaning rod or implement for the bore of guns and, more particularly, to a flexible cleaning implement particularly adopted for insertion and operation in the breech end of airguns.

It is recognized in the airgun art that, despite the fact that there may be no obviously visible indication of dirt in the bore of an airgun, periodic and frequent cleaning of the bore is necessary. A dirty bore is one of the most insidious and significant factors in negatively affecting accuracy of an airgun.

Even though airguns do not get fouled by powder residue as firearms do, their bores are subjected to soft lead residue due to the shallow rifling of the bore and the soft lead used in the airgun pellets. These pellets can be badly deformed by deep rifling or grooves; furthermore, airguns do not generate the explosive power behind the pellet (as firearms do) to drive the pellet through deep rifling, so only very shallow rifling is used to give aerodynamic spin to the pellet. A residue of soft lead accumulates in the bore and rapidly affects the rifling.

Additionally, the bore is dirtied by a lubricant residue which is caused by a subtle form of compression ignition of minute portions of gun lubricants with each shot of a spring-piston airgun. This residue, although not necessarily corrosive, builds onto the lead fouling of the bore to further directly decrease target accuracy.

Although the cleaning of airgun bores need not be as frequent as required for fireamrs, the cleaning procedure is far more exacting and delicate due to the shallow rifling. Chemical solvents and conventional firearm bore cleaners cannot be used on airguns as they would destroy the breech seal and probably the piston seal, as well.

Rigid or solid cleaning rods are frequently used for insertion into the muzzle end of the airguns, although cleaning by insertion through the breech end of the gun would be more desirable and effective. Sometimes, a swivel handle is provided for these rods. Many airguns can't accept breech insertion of a solid cleaning rod, and cleaning is restricted to insertion at the muzzle end, which could seriously damage the muzzle crown or rifling. Some flexible solid rods in the form of spring-wire or plastic-coated spring-wire or solid synthetic resin have been used for muzzle insertion to project them through the breech, where cleaning pellets or patches are attached for withdrawal through the bore and out the muzzle end. All of the metallic cleaning rods, whether rigid or flexible, require protective bushings, stops or the like to prevent damage to the lands and grooves of the bore or to the crown.

In the style of airgun where the breech can be exposed and made fully accessible to a cleaning rod, such as in a single pump spring action gun where the barrel can be folded out of the way or in a bolt action gun where the bolt can be removed, the above-described cleaning rods can also be used for breech insertion, but ordinarily they are restricted to muzzle insertion. During breech insertion these rods tend to kink or break due to the acute entry angle required in the confined breech area.

SUMMARY OF THE INVENTION

It is the primary object of the invention to provide an improved and more flexible airgun cleaning rod or implement particularly adapted for breech end insertion.

Another object of the invention is to provide an implement of the character described with a freely rotatable pusher end which will permit and encourage a cleaning piece or pellet to rotate, track and follow the rifling in the gun barrel.

A further object of the invention is to provide an implement of the character described with a form of pusher and which will engage a fibrous or matted cleaning pellet or slug in a fashion to compact and compress the trailing end of said pellet sufficiently to minimize the possibility of any loose fibers getting jammed between the pusher piece and the barrel of the airgun in a manner to interfere with the rifling.

To accomplish the foregoing, a cleaning rod is provided, having a longitudinally-extending flexible, non-metallic, tubular body of a pre-determined desired length. One end of the body has a suitable handle or finger-grip fixedly secured thereto, so that the body can be directly manually, as desired. The other end of the body has the unique form of pusher piece secured thereto for axial rotation in engagement with a cleaning piece.

Other objects and advantages of the invention will become apparent during the course of the following description and with reference to the following drawings, in which like numerals are used to designate like parts throughout the same.

DESCRIPTION OF THE PREFERRED EMBODIMENT

Figure 1:
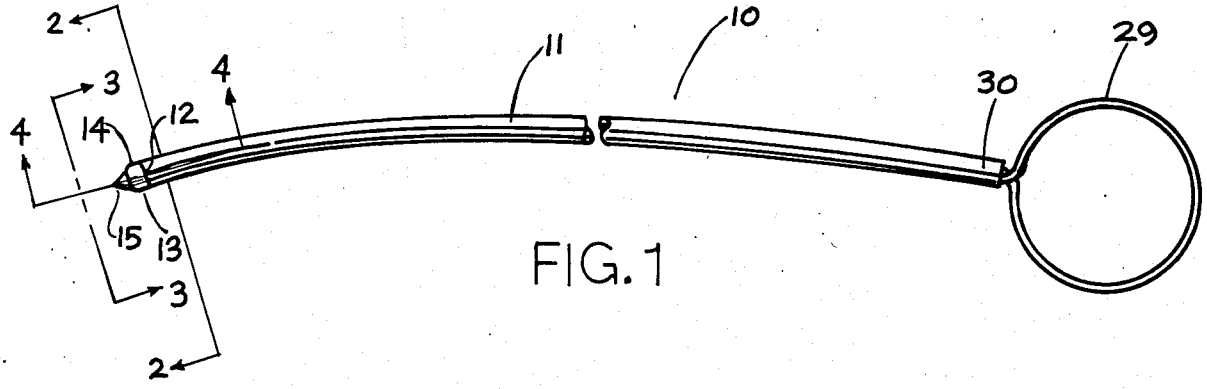
FIG. 1 is a plan view of a flexible cleaning rod or implement embodying the features of the invention.
Figure 2:
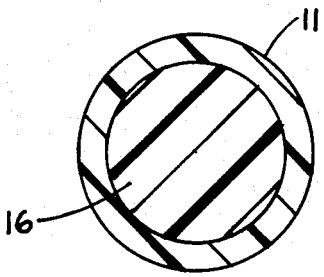
FIG. 2 is an enlarged transverse cross-section taken as indicated on line 2—2 of FIG. 1.
Figure 3:
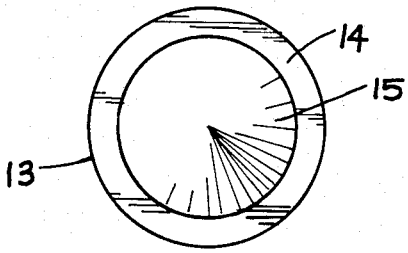
FIG. 3 is an enlarged view in elevation of the pusher end of the rod taken from the direction indicated by line 3—3 of FIG. 1.

Referring to FIG. 1 of the drawing, there is shown a bore-cleaning rod or implement 10 having a tubular, flexible body 11 of extruded synthetic resin having elastomeric characteristics. The preferred material for the body 11 is heat-resistant nylon tubing of the type suitable for high-pressure hydraulic applications. The material should be non-metallic so as to avoid damage to or marring of the bore and crown of the gun. It also should have a high degree of flexibility and resiliency to permit tight bends with no permanent deformation or kinking, which so often occurs with spring-wire and solid resin cleaning rods.

The leading end 12 of the body 11 has mounted thereon and secured thereto a pusher piece or assembly 13 which has a fixed part or portion 14 at its rear end and a cleaning pellet or slug-engaging part or portion 15 at its front end.

The part 14 has a cylindrical stem or shank 16 which is slightly over-size with respect to the nominal internal diameter of the tubular body 11. The shank is surmounted by an integral sleeve portion 17 of enlarged diameter and having an internal bore or cavity 18 which has a closed end or seat 19 and an open end 20. The open end is defined by an inwardly directed annular collar of flange 21.

The slug-engaging portion 15 has an annular groove 22 adapted to receive the yieldable flange 21 when the portion 15 is snapped into assembly with the portion 14. Thereby, the flange 21 retains the part 15 against relative longitudinal displacement while, at the same time, permitting axial rotation of the part 15 within the annular bearing surface provided by the flange or collar 21.

The part 15 can be of any desired symmetry or shape, but is here shown as consisting of two opposed cones 23 and 24 separated by the annular groove 22. The rearward cone 24 terminates in an apex or point 25 which is pivotally accomodated in a conical depression or recess 26 central of the closed end 19 of part 14. This arrangement provides a supplementary stabilizing point for the axial rotation of the portion 15.

The forward cone 23 has a forward apex or peak 27 from which its surface 28 diverges conically rearwardly toward the groove 22. Depending on the desired shape of the part 23 there could be one or more of such diverging surfaces.

A conventional cleaning pellet or slug (not shown), sized to snugly fit the bore to be cleaned, and conventionally made of compressible felted or matted fibrous material, is used for the actual cleaning operation.

The cleaning pellet is placed in the breech end of the gun, ahead of the cleaning rod or implement 10.

The pointed pusher piece 13 is then used to start the slug into the bore. The tubular body bends easily to accomodate to the entry angle required for insertion into the breech end of the gun. The body 11 of the cleaning rod is grasped with one hand closely adjacent to its entry point into the bore as it is slowly pushed into the gun barrel. At the same time, a finger grip 29 which is fixedly secured to the opposite or trailing end 30 of the body, can be manipulated with the other hand if desired to assist the entry of the rod onto the bore.

The rod is inserted slowly until the cleaning slug is expelled from the muzzle of the barrel, and then is withdrawn. The procedure is repeated with a fresh cleaning pellet until the slugs emerge clean from the barrel.

During this cleaning operation, the tip 27 of pusher part 15 penetrates the end of the cleaning slug and the divergent tapered surface 28 compacts the trailing end of the slug, so that no loose fibers will jam between the pusher part and the rifling in the barrel.

This compression or compacting of the cleaning slug also causes the slug to bite more deeply into the shallow rifling in the bore. The rotatable mounting of the pusher part 15 permits and encourages the cleaning slug to follow and track the rifling so that the cleaning job is more complete and effective as the cleaning rod pushes the cleaning slug through the bore.

Figure 4:
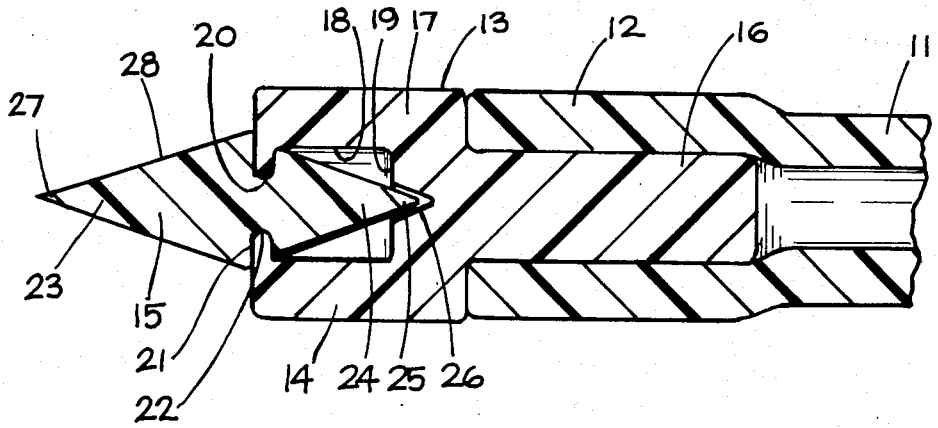
FIG. 4 is an enlarged longitudinal cross-section taken as indicated on line 4—4 of FIG. 1, and showing details of the pusher piece.

As best seen in FIG. 4, the walls of the tubular body 11 are resilient so as to create a frictional clamping action on the over-size shank 16 of the pusher part 14 when it is forced into the hollow end 12 of the body 11. This serves to fixedly connect the pusher assembly to the end of the body 11 for operating purposes. The finger-grip 29 may be similarly connected to the end 30 of the body, if desired, or other connecting means may be used to fixedly secure it.

It is to be understood that the form of my invention, herewith shown and described, is to be taken as a preferred example of the same and that various changes in the shape, size and arrangement of the parts may be resorted to without departing from the spirit of the invention or the scope of the subjoined claims.

Having thus described my invention, I claim:

1. In a bore-cleaning implement for an air rifle, the combination of: a longitudinally-extending non-metallic flexible tubular body having a manual gripping means mounted at the trailing end thereof and a pusher assembly mounted on the leading end thereof, said pusher assembly having a rotatable front part adapted to engage a compressible cleaning pellet positioned in the bore of said air rifle and to push the pellet through said bore and having a rear part secured to said tubular body, said front part having an axially-elongated generally conical pellet-engaging portion at its forward end and being mounted for axial rotation relative to the longitudinal axis of said body in response to rifling-induced rotation as said cleaning pellet is pushed axially through said bore, the outer surface of said conical portion diverging from the front to the rear, whereby the trailing portion of said pellet is compacted and compressed by engagement with said conical portion to a greater extent than the leading portion of said pellet.

2. A combination as defined in claim 1 wherein said tubular body is formed of nylon and said rear part of the pusher assembly has an non-rotatable axially-elongated stem with a diameter somewhat greater than the nominal internal diameter of said tubular body which stem extends rearwardly into a radially expanded end portion of said tubular body so as to be frictionally retained therein.

3. A bendable bore-cleaning implement for pushing cleaning pellets from the breech end to the muzzle end of a fixed-barrel air rifle comprising the combination of: a flexible non-metallic tube having a manual gripping means at the trailing end and a pusher assembly at the leading end adapted to engage a compressible cleaning pellet positioned in the bore of said air rifle and to push the same through said bore, said pusher assembly comprising a rear part secured to said tube and a front part mounted on said rear part for rifling-induced axial rotation in response to axial movement through said bore, said front part having an axially-elongated generally conical pellet-engaging portion which increased in diameter from the front to the rear to effect radial compression of the trailing portion of said pellet to a greater extent than the leading portion thereof.

4. A combination as defined in claim 3 wherein said rotatable front part has a rear portion with a rearwardly projecting tip and an annular groove located between the rear portion and the front portion of said front part, and wherein said rear part has a sleeve portion of enlarged diameter with an internal cavity having an open end at the front of said sleeve portion, a yieldable annular flange at said open end which fits in said annular groove to provide a bearing surface, and a closed rear end with a small central recess, said rear portion of the rotatable front part being located in said internal cavity with said tip projecting into said central recess.

5. A combination as defined in claim 3 wherein said rotatable front part consists of oppositely-directed coaxial forward and rearward conical portions separated by an annular groove and said rear part has an internal cavity with an open end defined by a yieldable annular flange that is adapted to permit insertion of the rearward conical portion into said cavity and that fits in said annular groove so as to prevent axial movement of said front part while permitting rotation thereof, said cavity having a closed rear end with a shallow central recess to receive the tip of the rearward conical portion.

* * * * *